US006581690B2

(12) United States Patent
Van Drentham-Susman et al.

(10) Patent No.: US 6,581,690 B2
(45) Date of Patent: Jun. 24, 2003

(54) WINDOW CUTTING TOOL FOR WELL CASING

(75) Inventors: Hector F. A. Van Drentham-Susman, Inverurie (GB); Kenneth Roderick Stewart, Aberdeen (GB)

(73) Assignee: Rotech Holdings, Limited, Aberdeen (GB)

( * ) Notice: Subject to any disclaimer, the term of this patent is extended or adjusted under 35 U.S.C. 154(b) by 0 days.

(21) Appl. No.: 10/021,387

(22) Filed: Oct. 30, 2001

(65) Prior Publication Data

US 2002/0070021 A1 Jun. 13, 2002

Related U.S. Application Data

(62) Division of application No. 09/078,071, filed on May 13, 1998, now abandoned.

(51) Int. Cl.[7] ..... E21B 29/06

(52) U.S. Cl. ..... 166/298; 166/55.1; 166/55.8

(58) Field of Search ..... 166/298, 55, 55.1, 166/55.2, 55.3–55.8; 175/73, 61

(56) References Cited

U.S. PATENT DOCUMENTS 1,454,048 A * 5/1923 Esperson ..... 166/298
1,805,515 A * 5/1931 Denney ..... 166/55.8
2,782,850 A * 2/1957 Condra ..... 166/55.8
4,416,339 A * 11/1983 Baker et al. ..... 175/61
5,009,273 A * 4/1991 Grabinski ..... 175/61
5,168,941 A * 12/1992 Krueger et al. ..... 175/26
5,311,952 A * 5/1994 Eddison et al. ..... 175/107
5,542,482 A * 8/1996 Eddison ..... 175/61
2001/0040054 A1 * 11/2001 Haugen et al. ..... 175/61

* cited by examiner

*Primary Examiner*—Hoang Dang
(74) *Attorney, Agent, or Firm*—John R Casperson

(57) ABSTRACT

The present invention provides an active downhole cutting tool guide device 14 for use in a hole 17 with sides between which a hole-cutting tool 15 mounted on a drill string and provided with said device may be disposed. The guide device 14 comprises at least one elongate longitudinally extending hole-side engagement member 20 mounted on a body 19 disposable, in use of the device, in-line with the drill string, so as to be movable relative to said body 19 between a retracted position and a radially outwardly displaced position for hole-side engagement. Each engagement member 20 has pressurized-fluid operable actuator mechanism 24 formed and arranged for driving said hole-side engagement member 20 between its retracted and hole-side engagement positions. The guide device 14 includes pressurized fluid supply mechanism 28, 18 formed and arranged for controlling the supply of pressurized fluid to the actuator mechanism 24, for operation thereof. In use of the guide device 14 the hole-cutting tool 15 may be directed relative to the central longitudinal axis of the hole 17 in which the tool 15 is disposed.

7 Claims, 4 Drawing Sheets

WINDOW CUTTING TOOL FOR WELL CASING

CROSS REFERENCES TO RELATED APPLICATIONS

This application is a divisional of application Ser. No. 09/078,071 filed May 13, 1998, now abandoned.

BACKGROUND OF THE INVENTION

The present invention relates to an active downhole cutting tool guide device for use in a hole with sides between which a hole-cutting tool provided with said device may be disposed.

There is a need for guiding of downhole cutting tools for various purposes including inter alia lateral hole cutting, directional drilling, as well as to stabilise an existing cutting tool advance direction against unwanted deviation therefrom. Existing solutions to such problems are generally cumbersome to use and/or unsuitable for use with coiled tubing.

There is a need for cutting windows in oil/gas well casings used to line the sides of well holes. Well casing is however normally very tough, thick walled steel pipe which is placed inside a borehole of a well as a lining to secure the borehole and prevent the walls thereof from collapsing. Casing—sometimes referred to as casing tubing—may be seamless, spiral welded or seam welded and may, for example, be fabricated from various API grades of steel such as H40, J55, N80 or P110. Sizes typically vary from around 4 inches (101.6 mm) OD to 30 inches (762 mm)OD, while weights typically range from around 11 lb/ft to 200 lb/ft (16.4 kg/m to 298 kg/m approximately) depending on diameter, thickness and grade. It has also been known to employ glass fibre reinforced plastic casing.

It is known that the cutting of windows in oil well casing, as required for side tracking, is a complicated process, normally requiring the use of a large number of tools not directly related to the cutting of the window itself, such as whipstocks, packers etc. The normal procedure is the setting of a cement plug on top of a packer above which a so-called "whipstock" is placed. The whipstock basically consists of a hard metal wedge which guides a window milling drill bit gradually into the casing thus cutting a slot in the casing. As the slope of the whipstock is of a low value the pinching action on the drill bit is very severe therefore requiring extremely high torque and yet a low rate of progress is achieved due to the high friction losses of the drill bit against the whipstock which have to be subtracted from the total energy available for the cutting of the window. Furthermore once the window has been cut the whipstock and packer require to be retrieved which is often a difficult and tedious process. To date the duration of an average window milling job is three to four days and often much longer.

There is also a need for stabilising drilling tools used to clear well holes which have become obstructed to a greater or lesser degree as a result of deposits on the sides thereof, and/or as a result of deformation of a well hole casing as a result of movement of the surrounding strata. Conventional near bit stabilisers are essentially passive devices, typically comprising a heavy duty ring with four angularly distributed wings which more or less closely approach the hole sides thereby limiting the amount of deviation of the cutting tool possible. With such stabilisers though the resistance to deviation remains substantially constant throughout use of the device, i.e., during travel of the cutting tool along clear sections of the hole when ease of travel is desired and stabilisation is not required, as well as during cutting through obstructions, so that in practice the degree of stabilisation available when it is required is substantially insufficient for proper stabilisation.

There is a further need for improved and less cumbersome methods of steering drilling tools for the purposes of directional drilling. Conventional directional drilling is typically effected by means of the use of so-called bent subs as illustrated schematically in FIG. 1. The drilling apparatus 1 shown has an indexer 2 for angular orientation of the drill bit 3 and drive system 4 therefor. In more detail the drive system comprises motor 5, typically a Moineau motor, a bent sub 7, and a bearing pack 8 which is connected to the drill bit 3. For straight ahead drilling the whole drill string comprising jointed tubing 9 from which the drilling apparatus 1 is supported is rotated at around 30 rpm so that the bent sub 7 rotates and the drill bit 3 orbits around the drill string axis while the motor 5 rotates at around 700 rpm to drive the drill bit 3 so that the drill bit 3 in effect follows a helical path. When it is desired to kick-off or change direction from the existing drill string axis, the rotation of the drill string is stopped in an arbitrary position and the indexer 2 operated to orientate the bent sub 7 in the desired angular direction. The motor 5 then drives the drill bit 3 while the drill string and bent sub 7 remain stationary, so that the drill bit 3 drills off at an angle determined by the bent sub 7. Once the required new drilling direction has been established, then the slow rotation of the whole drill string is resumed to provide straight ahead drilling in the new direction. Thus it may be seen that not only is the construction of the apparatus required for directional drilling relatively complex and cumbersome, but operation thereof is also awkward and inflexible.

OBJECTS OF THE INVENTION

It is an object of the present invention to obviate or mitigate at least some of the aforementioned problems and disadvantages in the prior art.

It is a further object of the present invention to provide a cutting tool guide device which may be used with coiled tubing with its inherently shorter positioning and retrieval times against the use of jointed oil field tubing.

It is another object of the invention to provide a cutting tool guide device suitable for down-hole use in a hole with sides between which a hole-cutting tool provided with said device may be disposed, whereby in use of the device at least one of the angle, the orientation and the lateral offset of a hole-cutting tool relative to the longitudinal axis of the hole in which said tool is disposed, may be controlled.

SUMMARY OF THE INVENTION

The present invention provides in one aspect an active downhole cutting tool guide device for use in a hole with sides between which a hole-cutting tool mounted on a drill string and provided with said device may be disposed, said device comprising at least one elongate longitudinally extending hole-side engagement member mounted on a body disposable, in use of the device, in-line with the drill string, so as to be movable relative to said body between a retracted position and a radially outwardly displaced position for hole-side engagement, each said at least one engagement member having pressurised-fluid operable actuator means formed and arranged for driving said hole-side engagement member between said retracted and hole-side engagement positions, said device including pressurised fluid supply means formed and arranged for controlling the supply of pressurised fluid, in use of the device, to said actuator means for operation thereof, whereby in use of the device a said hole-cutting tool may be directed relative to the central longitudinal axis of the hole in which said tool is disposed.

In use of the guide device of the invention, operation of the actuator means forces one (or more) said engagement member(s) into engagement with the hole-side. Where a resulting differential force is exerted at different sides of the hole, the drill string will tend to be displaced away from the central longitudinal axis of the hole so that the cutting tool can be driven laterally through the hole side and/or its forward cutting direction steered away at an angle from the previous forward cutting direction. Where an equal force is exerted by each of the engagement members (where two or more symmetrically angularly distributed ones are provided) on the hole sides around the drill string, then the drill string is positively directed so that the existing forward cutting direction of the cutting tool is stabilised.

Thus by means of the present invention guiding of cutting tools in a variety of downhole situations may be achieved in a particularly economic and effective manner.

In one form of the invention there may be used a single engagement member. In this case displacement of the engagement member into engagement with the hole sidewall to one side of the drill string will force the cutting tool against the hole sidewall to the other side of the drill string. This is useful in cutting windows in well casings by driving the cutting tool, conveniently a milling tool, laterally through the casing to cut a window therethrough. The window may then be elongated longitudinally of the well by driving the drill string forwards. In this type of arrangement, the angular directioning or orientation of the cutting tool (around the well) may be conveniently effected by means of a so-called indexing means (which is a well known remotely operable device used to set the angular orientation of a tool on drill string) to control the angular orientation of the guide device and hence of the engagement member around the well prior to operation of the actuator means so that the cutting tool is forced against the well casing at a desired side of the well.

In another form of the invention at least two angularly distributed, e.g., two diametrically opposed, engagement members may be used so that when their actuator means are operated simultaneously, the existing drill string direction is stabilised against deviation, for example by asymmetrical obstruction to the cutting tool. This is particularly useful when re-boring holes which have become obstructed to a greater or lesser degree, e.g., by the formation of deposits therein, or by deformation of the casing which could have arisen, for example, as a result of shifts in the surrounding strata. Where it is merely desired to provide stabilisation of an existing drill string direction, then control of the angular orientation of the guide device with its engagement members will not normally be required. Nevertheless if desired the guide device could be used in conjunction with an indexing device.

In yet another form of the invention, three or more, conveniently four, angularly distributed engagement members are provided in the guide device of the invention. In this case by using a pressurised fluid supply means formed and arranged for controlling the supply of pressurised fluid to the actuator means of the respective engagement members so that these are selectively operable, it is possible to use the guide device itself to control directioning of the drill string and hence of the cutting tool, not only simply away from the existing direction of the drill string, but also away in a particular angular orientation around the drill string, thereby avoiding the need for a separate indexing means. Conveniently in this case the pressurised fluid supply means includes valve means formed and arranged for controlling the relative supply of pressurised fluid to the various actuator means, said valve means having telemetric control signal receiving means formed and arranged for receiving valve control signals from a remote location, and valve actuation means coupled to said receiving means and formed and arranged for operation of said valves means in response to said valve control signals. A further advantage of the invention is that by using variable opening valve and pressure control and/or more or less rapid toggling of the valves, the present invention allows the possibility of effectively adjusting the angle of kick off and rate of deviation from the drill string axis and an existing drilling line which is not possible with conventional apparatus in which the bent sub has a fixed predetermined offset angle which provides only a fixed rate of deviation (angle for given forward movement).

Various forms of pressurised fluid supply means may be used in accordance with the present invention depending inter alia on the requirements of the particular guide device application. As described above, for directional drilling the pressurised fluid supply means comprises separate chambers for each actuator means for each hole side engagement member, which chambers are connected to the high and low pressure sides of the downhole motor and drill string via control valves. This type of arrangement could also, in principle, be used for other applications. More conveniently though somewhat simpler arrangements may be used where selective control of individual engagement members is not required as, for example, in stabilisers and in single engagement member applications such as window milling apparatus.

In such cases the pressurised fluid supply means may simply comprise a connection to the upstream side of restricted outlet drilling fluid exhaust passages at the cutting tool bit. When fluid is flowing through these under normal cutting tool operating conditions a substantial back pressure is built up behind the outlets so that the actuator means is subjected to a substantial pressure which drives the engagement member(s) to its (their) outwardly displaced position for hole side engagement. When such flow is substantially reduced or stopped, the back pressure is reduced so that the actuator means is subjected to a much lower pressure, which will reduce the outward displacement force on the engagement member(s) and allow the engagement member(s) to return to its (their) retracted position.

In the case of an application such as window milling, the cutting tool apparatus is passed down a well hole in a substantially stationary form. Once the milling tool is in position the drive motor is brought up to speed and substantial fluid flow through the exhaust passages established creating a back pressure therein, the actuator means operates to deploy the engagement member. When the motor is stopped and/or flow reduced, the pressure available to the actuator means falls and the engagement member allowed to retract, thereby permitting repositioning or withdrawal of the milling tool from the well hole.

In the case of an application such as a stabiliser, a motor driving the cutting tool will normally be run more or less continuously so that some back pressure is always available in the exhaust passages. By locating the exhaust passage outlets in cutting faces of the cutting tool so that these outlets are occluded to a greater or lesser extent when the cutting tool is in engagement with material to be cut, it will be appreciated that the back pressure is significantly increased during cutting so that the actuator means then operate to drive the engagement member into hole side engagement thereby automatically providing stabilisation of the drilling line just when it is needed. In such cases it will be appreciated that the pressurised fluid supply means and/or actuator means and/or any engagement member return means, typically a return spring, will be formed and arranged so that the engagement members are retained in a substantially retracted position at fluid supply pressures corresponding to free or no-load running of the cutting tool drive motor, and are only displaced outwardly at higher fluid supply pressures corresponding to cutting by the cutting tool.

According to another aspect of the present invention there is provided a milling apparatus suitable for use in milling a window in a well casing and comprising a rotary milling bit, motor means for driving the milling bit, and a guide device of the invention for positioning the milling bit in contact with a selected portion of the casing to be milled out.

According to yet another aspect of the present invention, there is provided a method of milling a window in a selected portion of a hole casing comprising the steps of:

providing a milling apparatus of the invention;

placing the milling apparatus within the casing;

operating the actuator means of the cutting tool guide device so as to position the milling bit in contact with the selected portion; and driving the milling bit so as to form a window in the casing.

Various kinds of pressurised fluid supply means may be used in accordance with the present invention. In general the device of the invention makes use of a drilling fluid flow passed down the drill string for one reason or another, typically drilling fluid exhausted from a positive displacement motor used to drive the hole cutting tool. Alternatively a separate by-pass fluid flow passage running in parallel with the fluid flow through the motor could be provided for supplying the guide device. The guide device of the present invention may be used with various kinds of down-hole motors but is generally used with a positive displacement motor. Although the guide device could in principle be used with a conventional Moineau motor, it is most preferably used with a rolling vane motor of the kind described in U.S. Pat. No. 5,518,379. (It should be noted here that the latter kind of motor may be used in various different kinds of form including those wherein the motor fluid flow passes radially outwards through the rotor and stator as specifically described in said patent, or radially inwards through the stator and then the rotor.) With this kind of motor a separate by-pass passage could be provided down the central longitudinal axis of the motor through the rotor though it is generally more convenient to use the motor without such an additional passage and simply use the fluid exhausted from the motor.

In general the actuator means are formed and arranged so that when the pressure of the fluid supply is increased, the actuators operate to drive the engagement member(s) from their retracted position to their radially outwardly displaced position. Advantageously the device includes resilient biasing means formed and arranged for returning the engagement member(s) to their retracted position when the fluid pressure is reduced again. Conveniently the actuator means are in the form of piston means mounted in cylinder means provided in said body of the guide device with a proximal end face in communication with said pressurised fluid supply and a distal end in driving abutment with a respective engagement member.

The pressure of the fluid flow to which the actuator means is subjected may be controlled in various ways known in the art including, for example, suitable telemetrically controlled valve means which may be operated so as to increase and reduce flow resistance downstream of the actuator means and hence back pressure whereby the fluid pressure acting on the actuator means may be varied. Advantageously though the actuator means are in communication with a fluid flow passage means which exhausts at the cutting tool, especially at a cutting surface thereof. This has the particular advantage that while the cutting tool is engaged with material to be cut, the fluid flow passage means outlet means is substantially occluded thereby increasing resistance to fluid flow and thus the back pressure in said fluid flow passage means so that the actuator means is exposed to an increased pressure, which in turn causes the engagement member(s) to be deployed and provide active positive directioning and guidance of the cutting tool. Once the material has been cut through and the outlets are no longer occluded by said material fluid flow increases and the pressure in the fluid flow passage means falls thereby allowing the engagement members to be retracted clear of the hole sides thereby in turn allowing the drill string to be freely advanced or retracted. Thus the operation of the actuator means can in such cases be substantially self-regulating with an increased displacement force being applied by the actuator means to the engagement member(s) as increased resistance to cutting (from the material being cut through) is experienced which is when the strongest guiding force is required, i.e., the engagement members require to be forced more powerfully against the hole sides. Furthermore, should the motor begin to stall during the course cutting, then the motor speed will begin to fall which results in a reduced fluid flow through the cutting tool which in turn results in a lower back pressure and thus reduced pressure at the actuator means. This in turn reduces the outward displacement force on the engagement member(s) so that these retract to a greater or lesser degree thereby reducing resistance to rotation of the drill string from friction between the engagement member(s) and the hole sides, and thus allow the motor speed to pick up again. Thus in this respect the guide device of the invention provides a further degree of self-regulation and a still further advantage over the prior art.

It will readily be appreciated that by configuring and/or dimensioning the pressurised fluid supply passages to the actuator means and the actuator means themselves suitably, a required displacement force to be applied to the engagement member(s) may be derived from a given fluid pressure. Typically there may be used an arrangement in which the fluid pressure at the actuator means is 150 to 200 psi (10 to 14 bar) when the cutting tool is running free and back pressure from the fluid outlets in the cutting tool is at a minimum, rising to 600 to 700 psi (41 to 48 bar) when the cutting tool is fully engaged with material being cut. In the case of those embodiments in which each engagement member is provided with a separate respective pressurised fluid supply chamber to allow independent control of the engagement members via a CMWD device (e.g., for directional drilling), the chambers are alternately connected to the high pressure and low pressure sides of the drill motor and drill string which would typically have a pressure differential of the order of 1200 to 1500 psi (83 to 103 bar).

According to another aspect of the present invention there is provided a milling apparatus suitable for use in milling a window in a well casing and comprising a rotary milling bit, motor means for driving the milling bit, and a guide device of the invention for positioning the milling bit in contact with a selected portion of the casing to be milled out.

According to yet another aspect of the present invention, there is provided a method of milling a window in a selected portion of a hole casing comprising the steps of:

providing a milling apparatus of the invention;

placing the milling apparatus within the casing;

operating the actuator means of the cutting tool guide device so as to position the milling bit in contact with the selected portion, and driving the milling bit so as to form a window in the casing.

In a further aspect the present invention provides a stabilised hole reboring apparatus suitable for use in reboring an asymmetrically obstructed hole, which apparatus comprises a rotary drilling bit, motor means for driving the drilling bit, and a guide device of the invention having at least two substantially symmetrically driven engagement members for stabilising the drilling bit against lateral deviation in use of the apparatus as it cuts through an obstruction.

The present invention also provides a method of reboring an asymmetrically obstructed hole comprising the steps of: providing a stabilised hole reboring apparatus of the invention; placing the stabilised hole reboring apparatus inside the asymmetrically obstructed hole; operating the actuator means of the cutting tool guide device so as to forcibly engage the hole sides above an obstruction thereby stabilising the drilling bit against lateral deviation; and driving the stabilised drilling bit so as to cut through the obstruction.

In a still further aspect the present invention provides a directional drilling apparatus suitable for use in directional drilling, which apparatus comprises a rotary drilling bit, motor means for driving the drilling bit, and a guide device of the invention having at least three angularly distributed independently driven engagement members operable for directing the drilling bit away from an existing drilling axis.

The present invention also provides a method of directional drilling comprising the steps of: providing a directional drilling apparatus of the invention; placing the directional drilling apparatus inside a hole; independently operating the actuator means of the respective engagement members of the cutting tool guide device so as to forcibly engage the hole sides so as to direct the drilling bit in a desired direction; and driving the directed drilling bit so as to bore a hole along a desired path.

As noted hereinbefore the actuator means for the respective engagement members may be independently operated by means of telemetric control. Various suitable kinds of telemetry are well known in the art. Conveniently there may be used so-called mud pulse telemetry in which the pressure applied to the drilling mud flow passed down the drill string has superimposed thereon a more or less rapidly changing pressure signal which is used to transmit data via a suitable pulse code containing synchronisation pulses and data bit pulses. Such telemetry means may also be used to monitor the drilling direction during the course of drilling using conventional MWD (measurement while drilling) techniques to facilitate accurate control of the guide device and thereby of the drilling direction.

A further particular advantage of the directional drilling guide device of the present invention is that it may be used with coiled tubing which has considerable operational advantages over conventional jointed tubing in downhole operations.

Conveniently the actuator means are in the form of piston means mounted in cylinder means provided in said body of the guide device with a proximal end face in communication with said pressurised fluid supply and a distal end in driving abutment with a respective engagement member.

Further preferred features and advantages of the invention will appear from the following detailed description given by way of example of some preferred embodiments illustrated with reference to the accompanying drawings in which:

DETAILED DESCRIPTION OF THE INVENTION

Figure 2:
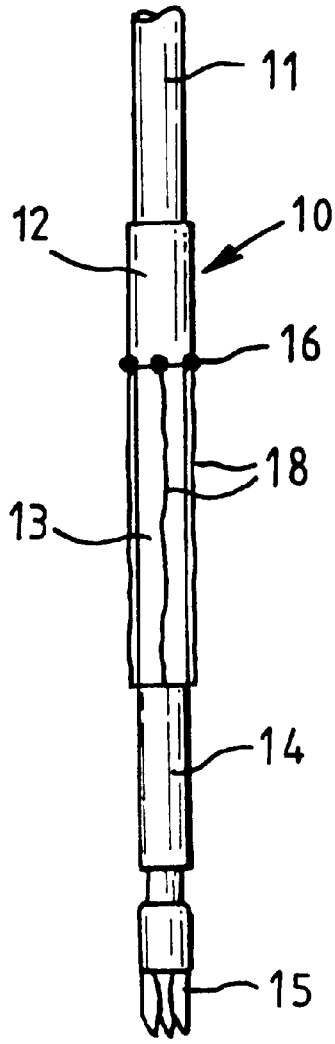
FIG. 2 is schematic side elevation of a drilling apparatus with a directional drilling guide device of the invention.
Figure 3:
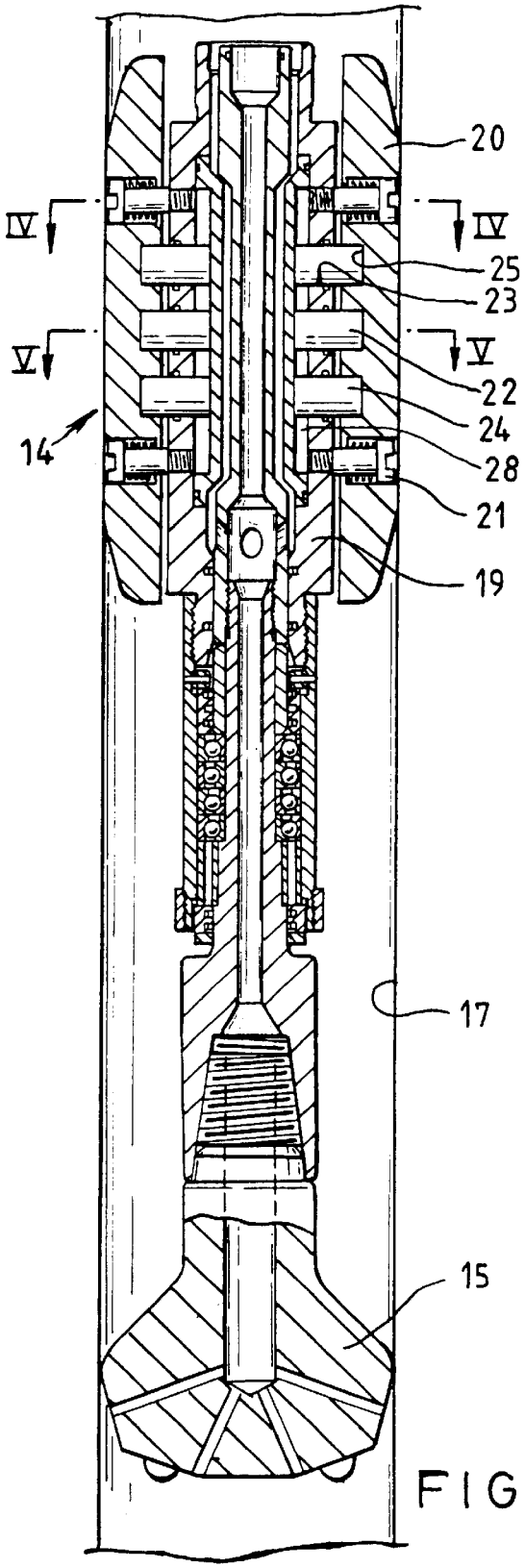
FIG. 3 is sectional side elevation of the guide device and drill bit of the embodiment of FIG. 2.
Figure 4:
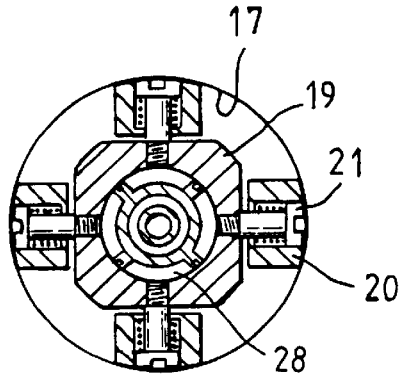
FIGS. 4 and 5 are transverse sections of the guide device of FIG. 3.
Figure 5:
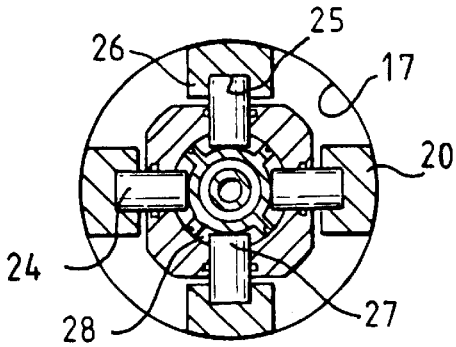

FIG. 2 shows a drilling apparatus 10 mounted at the end of a coiled tubing 11 and comprising a MCWD (Measurement & Control While Drilling) device 12 above a positive displacement rolling vane motor 13 (similar to that of U.S. Pat. No. 5,518,379), below which is mounted a guide device 14 and a drilling bit 15. The MCWD device 12 has a set of telemetrically controlled valves 16 which toggle connection of the high pressure and low pressure sides of the drill motor 13 and drill string via fluid flow pipes 18 to respective chambers of the guide device 14 as further explained hereinbelow.

In more detail, the guide device 14 comprises a central, generally octagonal section, body 19 having four elongate hole side engagement members 20 captively secured thereto by bolts 21. Each said engagement member 20 is provided with an actuator means in the form of a series of pistons 22 mounted in cylinder bores 23 in the body 19 with a distal end 24 located in a blind hole 25 in the base 26 of the engagement member 20 in abutment with the engagement member 20, and a proximal end 27 inside a pressurised fluid supply chamber 28. Return coil spring means 29 are mounted around the captive securing bolts 21 for biasing the engagement members 20 radially inwardly into their retracted positions.

When the chambers 28 are connected to the low pressure side of the drill string and drill motor via the control valves 16, the return springs tend to force the pistons 22 back into the chambers 28, draining any excess fluid therein back into the low pressure side of the drill string. When fluid pressure is increased inside the chambers 28 (by toggling the control valves 16 of the MCWD device 12 to connect to the high pressure side of the drill motor and drill string), the pistons 24 are displaced radially outwardly against the force of the return springs 29 into engagement with the sides of the well hole 17 as shown in the drawings. In these drawings the engagement members 20 are all shown equally displaced corresponding to equal opening of the control valves 16. This arrangement provides good stabilisation against lateral deviation. For the purposes of directional drilling, the control valves 16 are operated unequally by means of specific telemetric control instructions, so that at least one chamber 28 has a greater fluid pressure and the corresponding engagement member 20 is subjected to a greater driving force, than at least one other neighbouring chamber 28 and engagement member 20, whereby the engagement members 20 are displaced asymmetrically around the device with the result that the central axis of the guide device body 19 and hence of the drill bit 15 connected thereto is offset from the central axis of the well hole 17 above the drill bit 15 whereby the drill bit kicks off along a new drilling line at an angle to the existing one. As discussed hereinbefore, the guide device of the present invention offers a high degree of control and flexibility in relation to the kick off angle.

Figure 1:
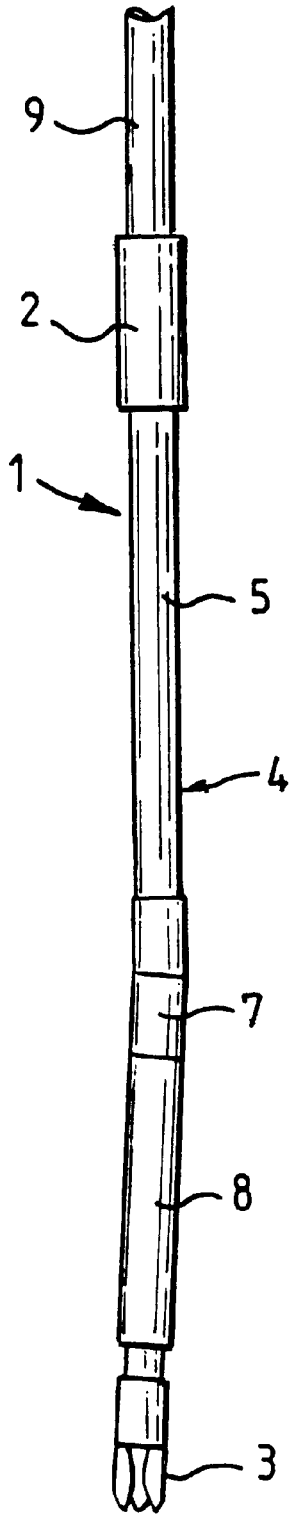
FIG. 1 PRIOR ART
FIG. 1 is a schematic elevation of a conventional directional drilling apparatus.

As may be seen from a comparison of FIGS. 1 and 2, the apparatus required for directional drilling in accordance with the present invention are considerably simpler in construction and ease of operation than conventional apparatus, with the need for bent subs, gear boxes, and extra motors being avoided. In addition, the present invention allows conventional indexing means to be dispensed with, although it is also possible to use a guide device of the invention in combination with a conventional indexing means if desired.

The guide devices of the apparatus of FIGS. 6 to 11 are similar in a number of respects to that of FIGS. 2 to 5, and like parts are indicated by like reference numbers. In both cases there is no need for independent control of different engagement members 20 so that there is no requirement for independent pressurised fluid supply chambers with associated fluid flow control, the or each engagement member being subjected to just one fluid pressure at any given time. Thus in the case of the stabiliser device 29 shown in FIGS. 9 to 11, the engagement members 20 are all displaced equally and symmetrically whereby the central axis of the body 19 is stabilised in line with central axis of the hole 17 therearound and against lateral deviation upon the hole clearing bit 30 coming into engagement with an asymmetrical obstruction 31 at one side of the hole 17.

Figure 6:
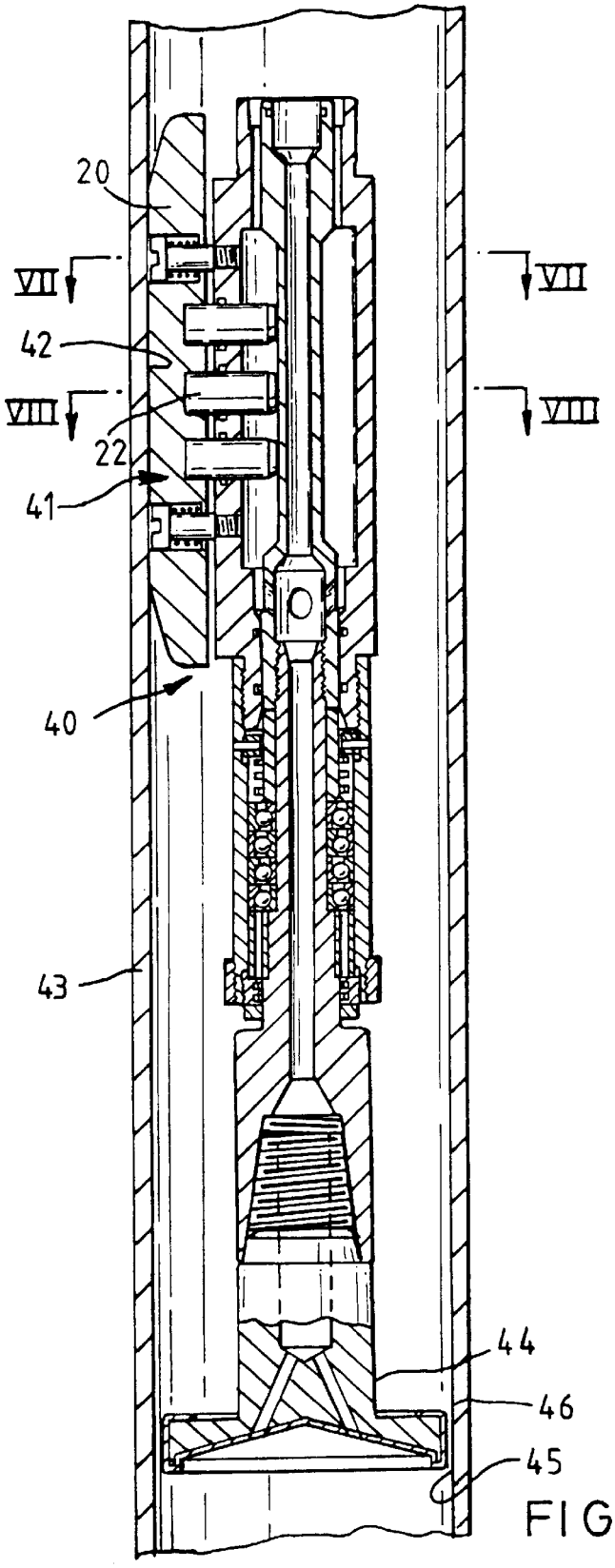
FIG. 6 is a sectional side elevation of the guide device and milling bit of a milling apparatus of the invention.
Figure 7:
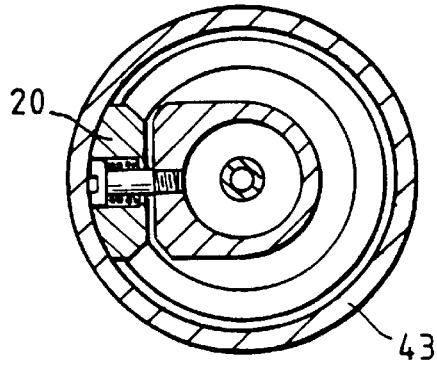
FIGS. 7 and 8 are transverse sections of the guide device of FIG. 6.
Figure 8:
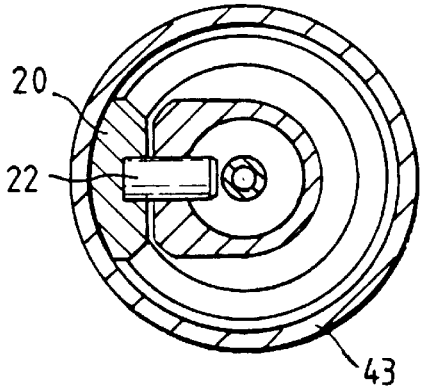
Figure 9:
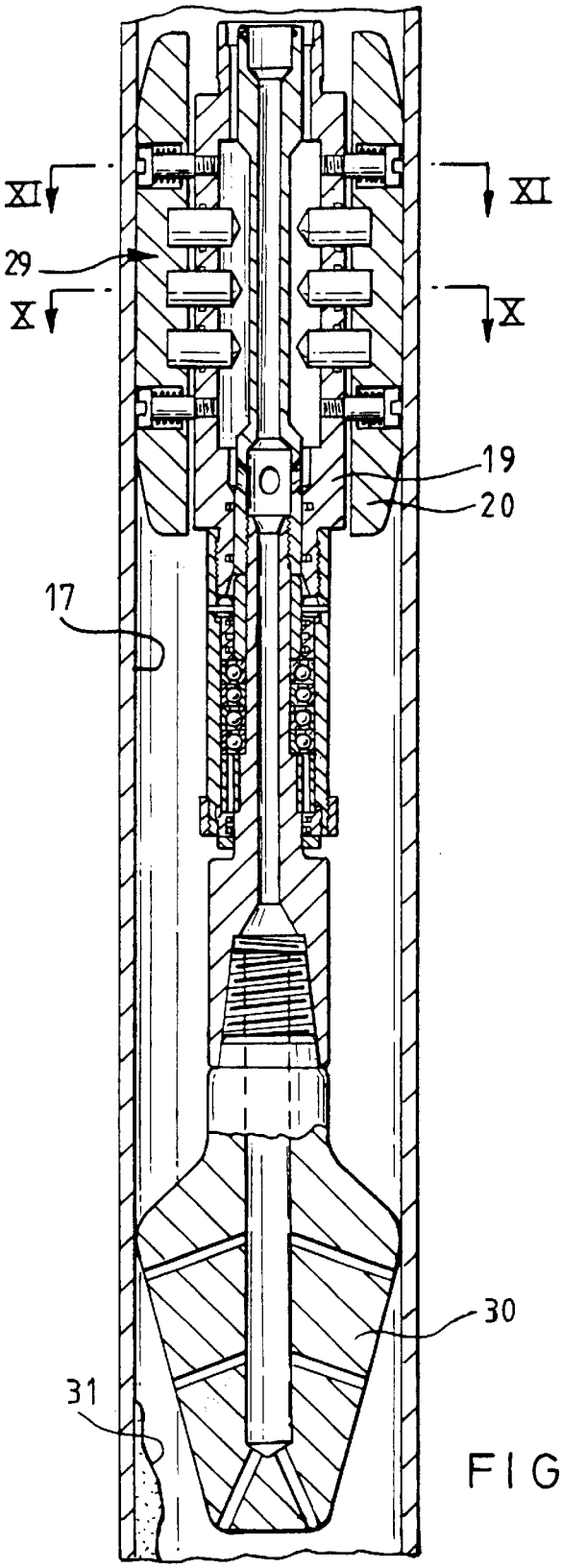
FIG. 9 is a sectional side elevation of a stabiliser guide device and drill bit of a hole clearing apparatus of the invention.
Figure 10:
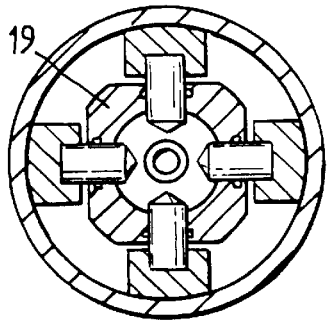
FIGS. 10 and 11 are transverse sections of the guide device of FIG. 9.
Figure 11:
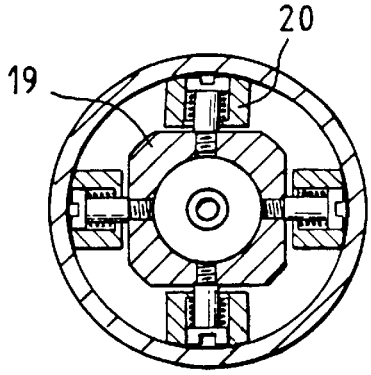

In the well casing window cutting apparatus 40 of FIGS. 6 to 8, the guide device 41 has only a single engagement member 20. When the actuator means comprising the pistons 22 is operated to displace the engagement member 20 radially outwardly against the side 42 of the hole casing 43, the milling bit 44 is driven against a portion 45 of the side 46 of the hole casing 43 in which it is desired to form a window. The angular orientation of the engagement member 20 and hence the portion of the hole casing 43 which will be engaged by the milling bit 44, is controlled by a conventional indexing device 2 mounted above a motor 12 (not shown in FIGS. 6 to 8). Once the milling bit 44 has cut through to the outside of the casing 43, the apparatus may be driven down the hole progressively to elongate the window (not shown) along the length of the casing 43.

What is claimed is:

1. A downhole well casing window cutting tool for use in milling a window in a wall of a well casing, said tool comprising a milling bit provided with a positioning device, said device comprising at least one elongate longitudinally extending well casing engagement member mounted on a body at a first side of said body, which body is disposable, in use of the device, in-line with a drill string, so as to be movable relative to said body between a retracted position and a generally radially outwardly displaced position for well casing engagement at said first side of said body in use of the device, each said at least one engagement member having pressurised-fluid operable actuator means formed and arranged for driving said at least one well casing engagement member between said retracted and well casing engagement positions, said device including pressurised fluid supply means formed and arranged for controlling the supply of pressurised fluid, in use of the device, to said actuator means for operation thereof, whereby in use of the device said milling bit may be displaced laterally relative to the central longitudinal axis of the well casing in which said milling bit is disposed, into engagement with the well casing at a second side of said body opposite to said first side, by operation of said actuator means.

2. The apparatus of claim 1 wherein is included an angular orientation control means for orientation of the milling bit for cutting engagement with a selected portion of the well casing when the guide device is operated.

3. The apparatus of claim 2 wherein said angular orientation control means comprises an indexing device.

4. The apparatus of claim 2 wherein said tool is supported on a coiled tubing drill string.

5. A method of milling a window in a selected portion of a well casing comprising the steps of:

providing a milling apparatus comprising a rotary milling bit, motor means for driving the milling bit, and a guide device for positioning the milling bit in contact with a selected portion of the casing to be milled out, wherein said guide device comprises at least one elongate longitudinally extending well casing engagement member mounted on a body, which body is disposable, in use of the device, in-line with the drill string, so as to be movable relative to said body between a retracted position and a generally radially outwardly displaced position for well casing engagement, each said at least one engagement member having pressurised-fluid operable actuator means formed and arranged for driving said well casing engagement member between said retracted and well casing engagement positions, said device including pressurised fluid supply means formed and arranged for controlling the supply of pressurised fluid, in use of the device, to said actuator means for operation thereof whereby in use of the device said milling bit may be directed relative to the central longitudinal axis of the well casing in which said milling bit is disposed;

placing the milling apparatus within the well casing;

operating the actuator means of the cutting tool guide device so as to position the milling bit in contact with the selected portion; and driving the milling bit so as to form a window in the well casing.

6. A method according to claim 5 wherein the milling apparatus further comprises an angular orientation control means for orientation of the milling bit for cutting engagement with a selected portion of the well casing when the guide device is operated;

and wherein said method includes the step of operating said angular orientation control means so as to orientate said guide device so that when said guide device is operated, said milling tool is brought into cutting engagement with a desired portion of the well casing.

7. A method according to claim 6 which includes the further step of driving the apparatus down the well casing progressively to elongate the window along the well casing.

* * * * *